United States Patent [19]

Cervisi

[11] 3,992,732

[45] Nov. 23, 1976

[54] BOX SPRING CONSTRUCTION

[76] Inventor: Richard Thomas Cervisi, 601 College Ave., Kentfield, Calif. 94908

[22] Filed: Dec. 29, 1975

[21] Appl. No.: 645,080

[52] U.S. Cl. ..... 5/263; 5/264 B; 5/351

[51] Int. Cl.[2] ..... A47B 23/04

[58] Field of Search ..... 312/239, 259, 236; 5/263, 264 R, 264 B, 351, 248, 256; 297/456

[56] References Cited

UNITED STATES PATENTS

| | | | |
|---|---|---|---|
| 179,770 | 7/1876 | Crich | 5/248 |
| 184,703 | 11/1876 | De Camp | 5/256 |
| 901,516 | 10/1908 | Billow | 5/248 |
| 2,202,052 | 5/1940 | Gleason | 5/264 R |
| 2,272,807 | 2/1942 | Kronheim | 5/264 R |
| 3,080,576 | 3/1963 | Cervisi | 5/264 R |
| 3,251,074 | 5/1966 | Levine | 5/263 |

*Primary Examiner*—Casmir A. Nunberg
*Attorney, Agent, or Firm*—Owen, Wickersham & Erickson

[57] ABSTRACT

A novel box spring construction is disclosed wherein sway is eliminated. The construction includes wooden framing members efficiently connected together at corners and frustoconical springs extending between transverse lower frame members and upper wire retainers. The wire retainers, connected at their ends to side and end frame members, serve to locate and prevent sway of the individual springs, while sway of the entire upper box spring surface is prevented by the wooden frame members and the corner construction. The springs are retained to the transverse lower frame members by passage of the lower spring ends through the members.

7 Claims, 8 Drawing Figures

FIG _ 1
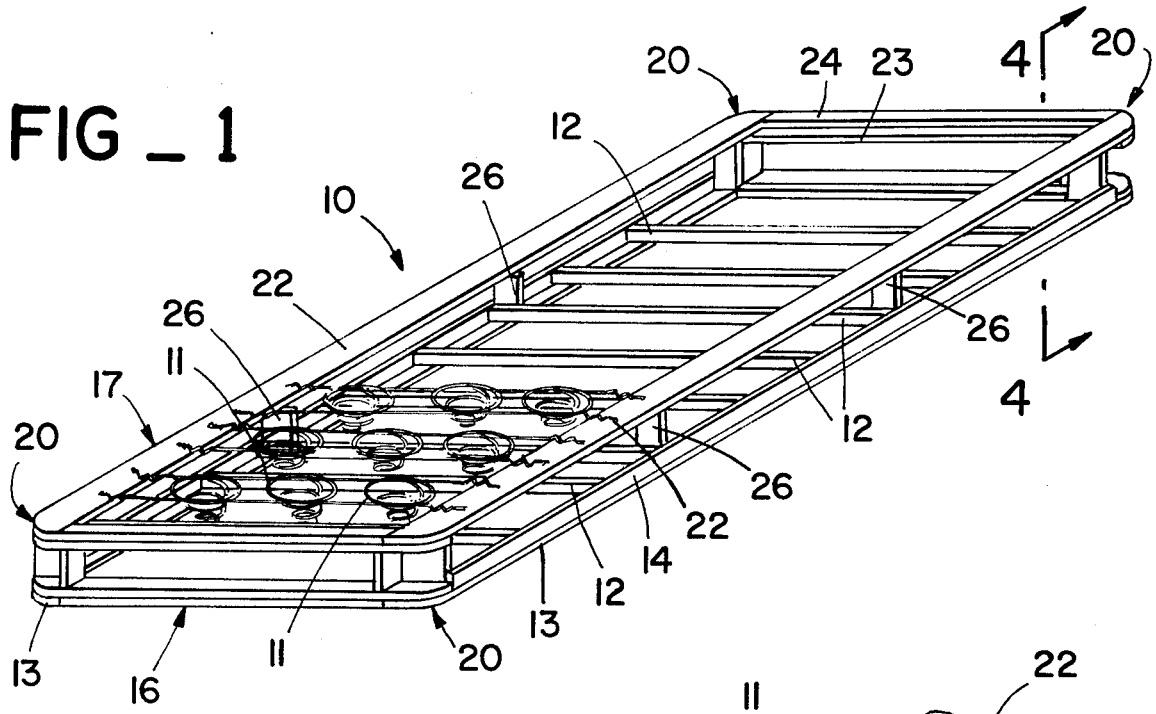
FIG _ 2
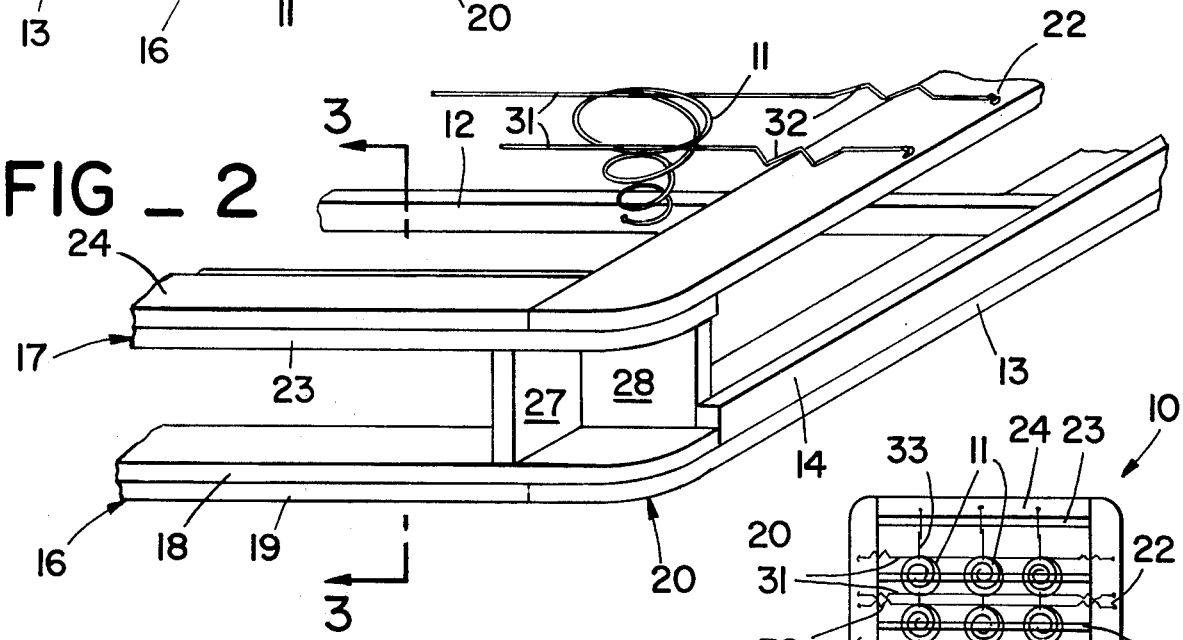
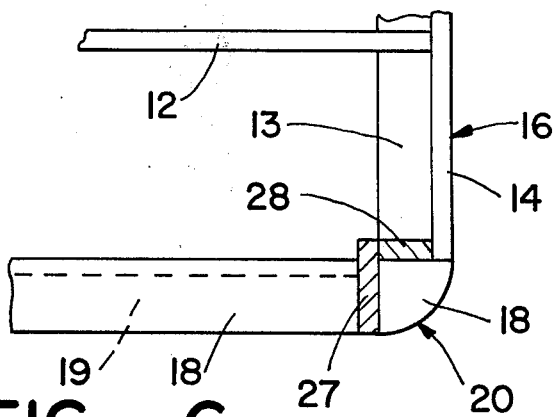
FIG _ 6
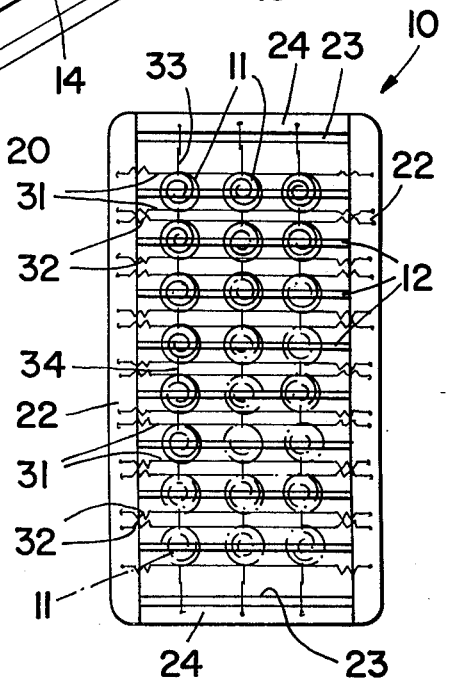
FIG _ 5 supported by an elongate wooden member 12 oriented at right angles to the length of the box spring and thus described as in transverse orientation, herein and in the appended claims. As best seen in FIG. 2, the transverse spring support members 12 are themselves supported by a pair of longitudinally and flatly oriented frame members 13 which extend through the length of the box spring and which may comprise 1 inch × 4 inch or 1 inch × 3 inch (nominal dimension) wooden members. Secured to the upper surfaces of the longitudinal frame members 13 adjacent to the outer edges thereof are a pair of elongate framing strips 14 which help frame in and support the transverse members 12, as well as adding supportive strength to the longitudinal members 13 when the box spring is used in a frame having non-continuous box spring supports. These strips 14 may be, for example, 1 inch × 2 inch (nominal dimension) wooden strips oriented with the 2 inch dimension vertical. Likewise, the transverse spring supporting members 12 may be formed of similar strips oriented with the 2 inch dimension vertical, as shown in FIGS. 1, 2, 3 and 6, for maximum strength and for accommodating the springs 11 in a particular type of connection described below.

The longitudinal frame members 13 and 14 form a part of a lower rectangular frame 16 which cooperates with an upper, similarly sized frame 17 to form the non-sway box spring construction of the invention. Also included in the lower frame 16 are end transverse members 18 and 19 connected to the side longitudinal members 13 and 14 at corners 20, as best seen in FIG. 2. The end transverse members 18 may be 1 inch × 3 inch or 1 inch × 4 inch (nominal dimension) wooden pieces like the longitudinal members 18, and are preferably positioned above and in overlapping engagement with the members 13 at corners as shown. The two frame members may be secured together by staples, glue or other fastening means, and the overlap construction shown assures maximum strength from such fastening.

The box spring corners 20 may be somewhat rounded as shown in FIGS. 1, 2 and 5 to avoid sharp edges and to help fit the box spring 10 into a bed frame.

Below the end transverse member 18 at each end of the box spring is the member 19, secured thereto by gluing, staples or other fasteners. This member, shorter than the member 18 in order to accommodate the ends of the longitudinal members 13 coplanar therewith, and not necessarily the full width of the member 18, acts as a depth filler for seating the box spring 10 in a bed frame and also as a strengthener of the ends of the box spring. It should be understood that the members 18 and 19 may be formed from a single piece if desired, as may the longitudinal lower frame members 13 and 14. The construction shown is preferred because of its economy of materials and assembly time.

The lower frame 16 supports the transverse spring support members 12 via the longitudinal side members 13 and 14 as discussed above. As with other connections in the box spring assembly 10, the connection between the support members 12 and the members 13 and 14 may be by glueing, staples or other fasteners.

Directly above and spaced from the lower frame 16 is the upper frame 17, generally similar in construction but differing in some respects. As seen in FIGS. 1, 2 and 3, longitudinal frame members 22 form the sides of the upper frame 17, while transverse members 23 and 24 define the ends. These members are preferably sized in accordance with their lower frame counterparts. The end members 23 and 24 are generally complementary with the lower transverse members 18 and 19, respectively, with similar and complementary connection to the adjacent longitudinal member, which in the case of the upper frame is the member 22. Similarly to the lower transverse member 19, the upper member 24 has the functions of adding strength to the span and filling the depth of the box spring ends to match that of the sides, so that a mattress can be evenly supported by the peripheral upper frame 17 and to accommodate spring stability means described below.

The upper frame 17 includes no longitudinal members corresponding to the lower members 14, since the upper frame does not directly support springs or spring-supporting transverse members and since intermediate spacer members 26 transmit vertical load from the upper members 22 to the lower members 13, thereby making the single-layer members 22 adequate in strength.

The primary purpose of the upper frame 17 is to enable the prevention of horizontal sway in the box spring 10. The rigid upper frame 17 is rigidly secured to the lower frame 16 by means of the intermediate spacers 26 as well as by a specific corner construction, described below, which efficiently secures the frames against relative horizontal movement, forming an important part of the invention. Another purpose of the upper frame 17 is to provide an anchoring structure for spring stabilizing means, also described below.

FIGS. 1, 2, 3, 4 and 6 illustrate the corner construction of the box spring assembly 10. At each corner 20 is a first rigid plate member 27, oriented vertically and extending between and in abutting contact (or substantially abutting contact, due to working tolerances) with the inner faces of the transverse upper and lower members 23 and 18. The first plate member 27 is preferably wider than the upper and lower members 23 and 18, overhanging from them somewhat as shown in FIGS. 3 and 6, so that it can be abutted with and connected to a second rigid plate 28, also oriented vertically but at right angles to the first plate, forming an L configuration. Unlike the first plate 27, the second plate 28 extends with its face in contact with edges of the upper and lower transverse members 23 and 18, and reaches into substantially abutting contact with outer longitudinal side members 22 and 13. The second plate 28 is thus vertically longer than the first by two board thicknesses, but is considerably narrower. As seen in FIGS. 4 and 6, the second plate 28 is narrower than the upper and lower side members 22 and 13 by the thickness of the side member 14. The members 27, 28, 23, 18, 22, 13 and 14 are preferably each secured to one another at all contacting or substantially contacting surfaces. Both plates are preferably wooden members, as are the intermediate spacer members 26 which may be identical to the second plate members 28.

Besides providing columnar support between the upper and lower frames, the plate members 27 and 28 prevent horizontal sway of the upper frame with respect to the lower frame in any direction, with a minimum of materials and assembly required.

FIGS. 7 and 8, as well as FIG. 2, show the connection of the springs 11 to the transverse spring support members 12, another important feature of the invention. As the figures indicate, the transverse members 12 are oriented with their larger dimension vertical, so that the lower ends of the preferably frusto-conical springs

BOX SPRING CONSTRUCTION

BACKGROUND OF THE INVENTION

The invention relates to mattress-supporting box springs, and more particularly to an improved, simplified box spring construction wherein sway is eliminated.

In the past most box springs included a wooden framework bottom, with an array of springs arranged in rows and connected to the framework bottom by staples or other fasteners. In a twin bed size box spring, depending upon the size of the individual springs used, a pattern of as many as nine rows of five springs each, or 45 springs, may be included. The springs of the array were generally tied together at their upper ends by wires, bands, springs or other connectors to maintain each spring in its proper position relative to the other springs during compression of various areas of the spring array. Often a stiff, heavy wire was included around the upper periphery of the box spring, perhaps connected directly to the outer edges of the top of the outermost springs in the array to define the upper edges of the box spring and to add to the rigidity of the spring array. Many such box spring assemblies were then supplied with a layer of padding material over the springs, and a fabric cover material completed the assembly.

Besides requiring such a large number and area of springs, such prior mattress construction also had the disadvantage of swaying considerably in response to side and end forces, often causing discomfort of those occupying the bed and a general instability of the bed. This swaying occurred because there was nothing rigidly securing the springs of even the heavy peripheral wire member against horizontal movement with respect to the lower framework. Thus, the tops of the springs were free to deflect horizontally as well as vertically. In addition, such construction was often relatively expensive because of high labor requirements in affixing the springs to the wooden framework, particularly with such a large number of springs, and also because of other inefficiencies of construction which significantly contrast with the box spring of the present invention described below.

In the prior art, U.S. Pat. No. 692,535 shows a seat spring and supporting member connection which is somewhat similar to the spring connection of the present invention. However, as will be seen below, the connection of that patent is considerably more elaborate than that of the present invention, being designated to give the spring upright stability as well as load support. The simplified connection of the present invention is not depended upon for such stability, other anti-sway means being provided.

SUMMARY OF THE INVENTION

The present invention provides a box spring construction which is relatively simple, inexpensive to manufacture, durable in service and completely free of sway which might otherwise be induced from horizontal side and end forces. The construction includes both upper and lower rectangular frames, connected together by structural members at corners and intermediate locations between the frames. These connecting structural members, and the members of the upper and lower frames themselves, are so oriented and connected as to provide a rigid border around the entire box spring assembly, at both top and bottom. This prevents undersirable sway undesirable the upper box spring surface, provides a rigid border for tying an internal array of springs against horizontal movement, significantly strengthens the box spring assembly and also has the advantage of reducing the number of springs required.

The assembly of the box spring of the invention, and the materials used to manufacture the box spring, are greatly simplified by the manner in which the springs are connected to the lower frame assembly. A series of transverse wooden members extend across the width of the lower frame at the locations of the rows of springs. Each transverse member includes a generally horizontal bore through its width at the location of each spring, the bores being approximately parallel to the length of the box spring. The bottom end of each spring is passed through a bore and crimped over along the side of the member. Each spring may be passed through two adjacent bores in the transverse member if desired, but it has been found that a single bore provides a sufficient connection since the connection need not provide upright stability in the spring. Such stability is established by the rigid upper frame and wires tying the spring tops to the frame.

Accordingly, some of the objects of the invention are to provide a simple, efficient and durable box spring assembly which is inexpensive to manufacture but which is so constructed as to prevent horizontal sway of its upper mattress-supporting surface with respect to the bottom of the box spring.

Other objects, advantages and features of the invention will become apparent from the following detailed description of one embodiment taken in conjunction with the accompanying drawing.

DESCRIPTION OF THE DRAWINGS

FIG. 1 is a perspective view of a box spring assembly according to the invention, shown with padding and fabric covering removed and indicating only some of the springs included in the assembly;

FIG. 2 is an enlarged perspective view of a corner portion of the box spring assembly shown in FIG. 1;

FIG. 5 is a plan view of the box spring assembly;

FIG. 6 is a sectioned plan view taken along the line 6—6 of FIG. 4;

DESCRIPTION OF A PREFERRED EMBODIMENT

Figure 3:
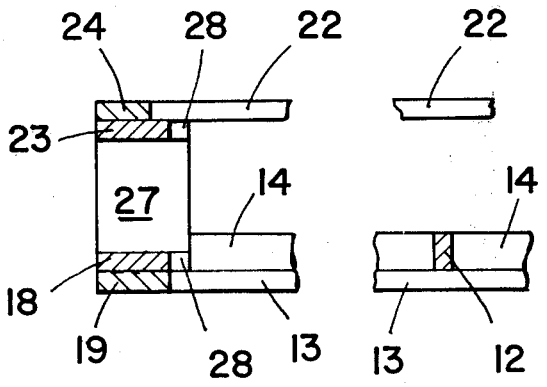
FIG. 3 is a sectioned elevational view taken along the line 3—3 of FIG. 2.
Figure 4:
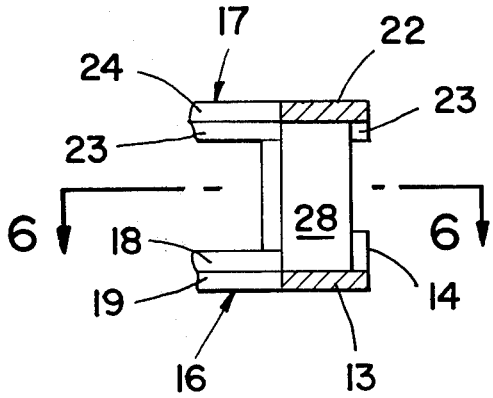
FIG. 4 is a sectioned elevational view taken along the line 4—4 of FIG. 1.

In the drawings, FIG. 1 shows a box spring assembly generally indicated by the reference number 10, excluding any surface padding or fabric covering which may be added later. The illustrated embodiment of the box spring 10 is designed to support a single bed mattress (not shown), and to be received in a single bed frame (also not shown), but it may be produced in any width and length.

Figure 7:
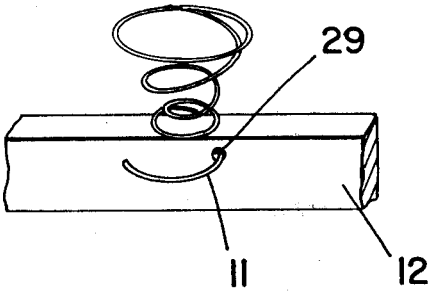
FIG. 7 is a perspective view showing the connection of a spring of the box spring assembly to a transverse structural member.
Figure 8:
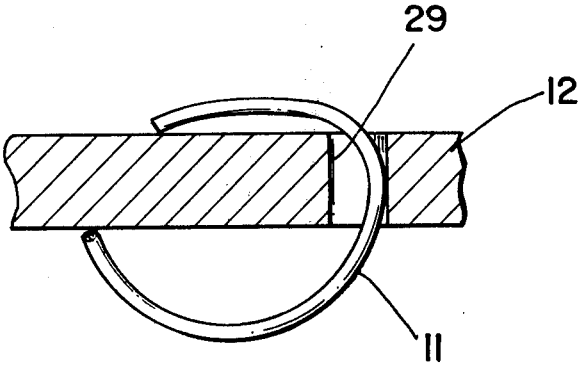
FIG. 8 is a sectioned plan view of the connection shown in FIG. 7.

As indicated in FIG. 1 and FIG. 5, the box spring 10 of the invention preferably includes a 3 by 8 pattern of frusto-conically shaped coil compression springs 11. Each row of three springs 11 is positioned over and 11 can be received through bores 29 through the thickness of the members 12. When a spring 11 has been passed through a bore 29, it is then crimped nearly flatly against the side of the member 12 as best seen in in FIGS. 7 and 8. It has been found that this simple connection, in conjunction with upper spring stabilizing and guide means discussed below, provides adequate support for the mattress-carrying compression springs 11 without the need for multiple fastening of the lowest spring coil to a spring supporting structure. The connection is made easily and rapidly during manufacture of the box spring 10, with the bores 29 providing pre-existing locating guides for the springs 11, since they are preferably drilled prior to assembly of the transverse members on the lower frame 16.

On the surface of the upper frame 17 are the spring stabilizing and guide means, preferably consisting of a number of wires fastened to the longitudinal and transverse members 22 and 24, and between the springs 11 themselves, and extending in both directions. The springs may be guided against transverse tilting movement by pairs of transverse wires 31, one pair provided for each row of springs, extending from one upper side member 22 to the other and twisted around or otherwise connected to opposite sides of the top coil of each spring in the row involved, as indicated in FIGS. 1, 2 and 5. These wires may be substantially taut in the uncompressed position of the springs, with stretch absorbing bends 32 at one or both ends of each wire to yieldably tension the wire. The ends of the wires 32 may be secured to the longitudinal members 22 by stapling or other fastening means. By keeping a restraining force on the tops of the springs, the wires 32 maintain the springs of a row substantially upright in the uncompressed position and during compression of the springs, so that sway is prevented here as well as at the periphery of the box spring.

Arranged lengthwise at the surface of the box spring 10 are series of wire links 33 and 34 linking the end springs to the upper end frame members 24, and linking each spring to an adjacent longitudinally-spaced spring, respectively. These links have the same function as that of the transverse wires 32, except that they act to prevent end-to-end tilting or sway of the springs 11. Stretch absorption is provided in this direction by the tops of the springs themselves.

In the box spring construction of the present invention, unlike prior constructions, the springs are tied to a rigid, unmovable upper frame, so that sway of the springs, as well as of the entire upper box spring surface, is eliminated. In prior box springs a border wire was usually employed, unsecured to the bottom frame, so that the entire surface could sway together, and means were required for fastening the spring bottoms to lower frame members as stably as possible in order to approach an acceptable degree of stability at the surface. Such means are not required in the present construction since the springs are maintained upright by means other than the rigidity of the springs themselves.

The above described preferred embodiment provides a box spring construction which is economical to manufacture as well as durable and sway-free in service. Various minor changes in construction and widely differing embodiments will suggest themselves to those skilled in the art and may be made without departing from the spirit and scope of the invention as defined in the following claims.

I claim:

1. A box spring construction, including an upper rectangular wooden frame and a lower rectangular wooden frame, rigid wooden corner connecting means establishing a spacing between the two frames and preventing sway of the upper frame with respect to the lower frame, transverse and longitudinal wire retaining means extending horizontally across the upper frame generally in the plane of the upper frame, transverse wooden members extending across the lower frame, and coil springs extending vertically between and connected to the transverse wire retaining means and the transverse wooden members, with the connection between the coil springs and the transverse wooden members made by the passage of the spring end through a bore in the wooden member.

2. The box spring construction of claim 1 wherein said upper and said lower rectangular wooden frames include elongate wooden members of widths greater than their depths, with the widths oriented horizontally, and said corner connecting means comprises, at each corner, a pair of rigid wooden plates extending vertically between the upper frame and the lower frame, one oriented longitudinally and the other transversely, each being connected at at least two points along each of its upper and lower surfaces to the upper and lower frames.

3. The box spring construction of claim 1 wherein each of the upper and lower frames comprises a pair of longitudinal side members and a pair of transverse end members, each member having a width greater than its depth, oriented with its width horizontal, and extending to the extremities of the box spring, with the side members overlapping the end members at corners, the side members being above the end members in the upper frame and below the end members in the lower frame.

4. The box spring construction of claim 3 wherein said transverse end members each include a depth filler portion of depth substantially equal to that of the longitudinal side members, extending between the longitudinal side members and positioned at the upper and lower extremes of the box spring in substantially flush arrangement with the surfaces of the longitudinal side members, whereby the overall depth of the frame is substantially constant around its periphery.

5. The box spring construction of claim 3 wherein said corner connecting means comprises, at each corner, a first rigid plate extending between the upper and lower frames and oriented perpendicularly to the general plane of the box spring and parallel to the sides of the box spring, said first plate having upper and lower edges in substantially abutting contact with and secured to upper and lower transverse end members, and a second rigid plate perpendicular to the first plate and parallel to the ends of the box spring, said second rigid plate having upper and lower edges in substantially abutting contact with and secured to upper and lower longitudinal side members with one face of the plate abutting against and secured to an edge of the adjacent upper transverse end member and to a corresponding edge of the adjacent lower transverse end member.

6. The box spring construction of claim 5 wherein said first rigid plate is secured to said second rigid plate in an L configuration.

7. A simplified, non-sway box spring construction including an upper generally rectangular rigid wooden frame, a lower generally rectangular rigid wooden frame of substantially the same outer dimensions as the upper frame and positioned in aligned and parallel relationship with the upper frame, means connecting the upper and lower frames and maintaining a spacing therebetween, means connected to both frames for preventing sway of the upper frame with respect to the lower frame in any horizontal direction, a plurality of support springs positioned in vertical orientation interior of the frames and extending substantially from the plane of the lower frame to the plane of the upper frame, a plurality of transverse members secured to and extending across the lower frame, each transverse member including at least one generally horizontal bore through the width of the member at the location of each support spring, with the lower end of the support spring passing through the bore to secure the spring to the transverse member, and sway preventing means connected to the upper ends of the springs and to the upper frame for maintaining the springs in generally vertical orientation.

* * * * *